US010947813B2

(12) United States Patent
Ejim et al.

(10) Patent No.: US 10,947,813 B2
(45) Date of Patent: Mar. 16, 2021

(54) SYSTEMS AND METHODS FOR PREVENTING SAND ACCUMULATION IN INVERTED ELECTRIC SUBMERSIBLE PUMP

(71) Applicant: Saudi Arabian Oil Company, Dhahran (SA)

(72) Inventors: Chidirim Enoch Ejim, Dhahran (SA); Jinjiang Xiao, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 90 days.

(21) Appl. No.: 16/049,016

(22) Filed: Jul. 30, 2018

(65) Prior Publication Data

US 2020/0032617 A1 Jan. 30, 2020

(51) Int. Cl.

| | |
|---|---|
| ***E21B 34/10*** | (2006.01) |
| ***E21B 43/12*** | (2006.01) |
| ***E21B 47/008*** | (2012.01) |
| ***E21B 34/08*** | (2006.01) |

(52) U.S. Cl.

CPC ..... *E21B 34/10* (2013.01); *E21B 43/128* (2013.01); *E21B 34/08* (2013.01); *E21B 47/008* (2020.05); *E21B 2200/06* (2020.05)

(58) Field of Classification Search

CPC ..... E21B 34/10; E21B 43/12; E21B 43/128; E21B 47/0007; E21B 2034/007

See application file for complete search history.

(56) References Cited

U.S. PATENT DOCUMENTS

| | | | |
|---|---|---|---|
| 6,330,915 | B1 | 12/2001 | Moya |
| 7,635,030 | B2 | 12/2009 | Knight et al. |
| 9,181,785 | B2 | 11/2015 | Lawson et al. |
| 9,441,435 | B2 | 9/2016 | Leitch |
| 9,611,719 | B2 | 4/2017 | Hofman et al. |

(Continued)

FOREIGN PATENT DOCUMENTS

| | | | |
|---|---|---|---|
| CN | 201013577 | Y | 1/2008 |
| CN | 201152165 | Y | 11/2008 |

(Continued)

OTHER PUBLICATIONS

International Search Report and Written Opinion for related PCT application PCT/US2019/044121 dated Oct. 18, 2019.

*Primary Examiner* — Tara Schimpf
*Assistant Examiner* — Manuel C Portocarrero
(74) *Attorney, Agent, or Firm* — Bracewell LLP; Constance G. Rhebergen; Linda L. Morgan

(57) ABSTRACT

Systems and methods for providing artificial lift to wellbore fluids include a pump located within a wellbore. A motor is located uphole of the pump and a protector assembly is located between the pump and the motor. A downhole packer is located within the wellbore downhole of the pump. A sand diverter is located downhole of the pump and has a flow port assembly located uphole of the downhole packer, the sand diverter having a diverter inner bore in fluid communication with the wellbore downhole of the downhole packer. The flow port assembly has an inner sleeve that is moveable between an open position where an inner sleeve port assembly is aligned with an outer sleeve port assembly of an outer sleeve, and a closed position where the inner sleeve port assembly is unaligned with the outer sleeve port assembly.

23 Claims, 4 Drawing Sheets

(56) References Cited

U.S. PATENT DOCUMENTS

| | | | | |
|---|---|---|---|---|
| 2003/0145989 | A1* | 8/2003 | Shaw | E21B 43/128 166/265 |
| 2010/0116508 | A1* | 5/2010 | Oglesby | E21B 43/128 166/369 |
| 2017/0328190 | A1 | 11/2017 | Fielder et al. | |

FOREIGN PATENT DOCUMENTS

| | | | |
|---|---|---|---|
| CN | 202500529 | U | 10/2012 |
| GB | 2361017 | A | 10/2001 |
| GB | 2411416 | A | 8/2005 |
| GB | 2549751 | A | 11/2017 |
| WO | 2007026142 | A1 | 3/2007 |

* cited by examiner

SYSTEMS AND METHODS FOR PREVENTING SAND ACCUMULATION IN INVERTED ELECTRIC SUBMERSIBLE PUMP

BACKGROUND OF THE DISCLOSURE

1. Field of the Disclosure

The present disclosure relates to electric submersible pumps used in hydrocarbon development operations, and more specifically, the disclosure relates to an inverted electric submersible pump completion with a downhole packer.

2. Description of the Related Art

In hydrocarbon developments, it is common practice to use electric submersible pumping systems (ESPs) as a primary form of artificial lift. As an example tubing-deployed inverted ESPs installed between an uphole packer and downhole packer, or through-tubing cable deployed ESP systems which sting into a polished bore receptacle can be used to provide artificial lift. During pump shutdown, sand in the wellbore can be trapped at the bottom of the completion. Frequent shutdowns result in accumulation of the trapped sand over time such that it is difficult to pull out the system during pump retrieval. Furthermore, depending on the amount of sand accumulation, the pump discharge may be blocked preventing production of hydrocarbons to the surface.

SUMMARY OF THE DISCLOSURE

Systems and methods of this disclosure reduce the risk of inverted ESPs getting stuck as a result of solid particle accumulation during field operation. A sand diverter is installed at the downhole region of the ESP string that creates an access for the sand and other solid particles to drain downhole of the downhole packer when the pump is shut down. This also prevents an amount of the sand from going through the ESP, increasing ESP operational reliability and economic return for the field operator. When the pump is shut down, fluid that contains entrained sand will follow a path of least resistance. Because there is a tortuous flow path through the ESP, the fluid that contains entrained sand will preferentially flow through the sand diverter. With the fluid that contains entrained sand being diverted downhole, embodiments of this disclosure do not require being sized or elongated to include a capacity for sand storage.

In an embodiment of this disclosure, a system for providing artificial lift to wellbore fluids has a pump located within a wellbore, the pump oriented to selectively boost a pressure of the wellbore fluids traveling from the wellbore towards an earth's surface through a production tubular. A motor is located within the wellbore uphole of the pump and provides power to the pump. A protector assembly is located between the pump and the motor. The pump, the motor, and the protector assembly form an electric submersible pump system. A downhole packer is located within the wellbore downhole of the pump. A sand diverter is located downhole of the pump and has a flow port assembly located uphole of the downhole packer. The sand diverter has a diverter inner bore in fluid communication with the wellbore downhole of the downhole packer, where the flow port assembly has an inner sleeve that is moveable between an open position where an inner sleeve port assembly is aligned with an outer sleeve port assembly of an outer sleeve, and a closed position where the inner sleeve port assembly is unaligned with the outer sleeve port assembly.

In alternate embodiments, the system can further include a biasing member, the biasing member positioned to bias the inner sleeve towards the closed position. The sand diverter can further include a counter pressure member, the counter pressure member oriented so that when the pump is off, a force on the counter pressure member overrides a force of the biasing member, moving the inner sleeve towards the open position.

In other alternate embodiments, the system can further include a biasing member, the biasing member positioned to bias the inner sleeve towards the open position. The sand diverter can further include a counter pressure member, the counter pressure member oriented so that when the pump is on, a force on the counter pressure member overrides a force of the biasing member, moving the inner sleeve to the closed position.

In yet other alternate embodiments, the sand diverter can further include a head member, the head member positioned uphole of the outer sleeve and having a head shoulder positioned to limit uphole movement of the inner sleeve relative to the outer sleeve. The inner sleeve can have a fully extended station where an uphole end of the inner sleeve contacts the head shoulder, and where in the fully extended station the inner sleeve is in the closed position. The sand diverter can further include a base member, the base member positioned downhole of the outer sleeve and having a base shoulder positioned to limit downhole movement of the inner sleeve relative to the outer sleeve. The inner sleeve can have a fully contracted station where a downhole end of the inner sleeve contacts the base shoulder, and where in the fully contracted station the inner sleeve is in the open position.

In still other alternate embodiments, the inner sleeve port assembly can include a plurality of individual inner sleeve openings, the plurality of individual inner sleeve openings spaced around a circumference of the inner sleeve to form a row of inner sleeve openings, and with two or more rows of inner sleeve openings spaced along an axial length of the inner sleeve. The outer sleeve port assembly can include a plurality of individual outer sleeve openings, the plurality of individual outer sleeve openings spaced around a circumference of the outer sleeve to form a row of outer sleeve openings, and with two or more rows of outer sleeve openings spaced along an axial length of the outer sleeve. The sand diverter can further include a plurality of port seals, each of the plurality of port seals forming a seal between the inner sleeve and the outer sleeve and where one of the plurality of port seals can be located uphole an uphole-most row of inner sleeve openings, one of the plurality of port seals can be located downhole of a downhole-most row of inner sleeve openings, and other of the plurality of port seals can be located between each adjacent row of inner sleeve openings.

In still yet other alternate embodiments, a sand skirt can be located uphole of the downhole packer, the sand skirt having a sloped inner diameter surface with an uphole end of the sand skirt having a larger inner diameter than an inner diameter of a downhole end of the sand skirt. A fluid discharge can be located between the pump and the protector assembly, the fluid discharge directing fluid out of the pump and into an annular space between an outer diameter surface of the electric submersible pump system and an inner diameter of the wellbore. A flow coupling can be located uphole of the motor, the flow coupling directing fluid from the annular space between the outer diameter surface of the electric submersible pump system and the inner diameter of the wellbore and into the production tubular. A stinger can be located downhole of the sand diverter, the stinger extending through the downhole packer and having a stinger inner bore in fluid communication with the diverter inner bore.

In an alternate embodiment of this disclosure, a method for providing artificial lift to wellbore fluids includes locating a pump within a wellbore, the pump oriented to selectively boost a pressure of the wellbore fluids traveling from the wellbore towards an earth's surface through a production tubular. A motor is located within the wellbore uphole of the pump and provides power to the pump with the motor. A protector assembly is located between the pump and the motor, where the pump, the motor, and the protector assembly form an electric submersible pump system. A downhole packer is located within the wellbore downhole of the pump. A sand diverter is located downhole of the pump such that a flow port assembly of the sand diverter is located uphole of the downhole packer. The sand diverter has a diverter inner bore in fluid communication with the wellbore downhole of the downhole packer, where the flow port assembly has an inner sleeve that is moveable between an open position where an inner sleeve port assembly is aligned with an outer sleeve port assembly of an outer sleeve, and a closed position where the inner sleeve port assembly is unaligned with the outer sleeve port assembly.

In alternate embodiments, the inner sleeve can be biased towards the closed position with a biasing member. The sand diverter further can include a counter pressure member, the counter pressure member oriented so that when the pump is off, a force on the counter pressure member overrides a force of the biasing member, moving the inner sleeve towards the open position.

In other alternate embodiments, the inner sleeve can be biased towards the open position with a biasing member. The sand diverter can further include a counter pressure member, the counter pressure member oriented so that when the pump is on, a force on the counter pressure member overrides a force of the biasing member, moving the inner sleeve to the closed position.

In yet other alternate embodiments, uphole movement of the inner sleeve can be limited relative to the outer sleeve with a head shoulder of a head member of the sand diverter, the head member positioned uphole of the outer sleeve. Downhole movement of the inner sleeve can be limited relative to the outer sleeve with a base shoulder of a base member of the sand diverter, the base member positioned downhole of the outer sleeve.

In still other alternate embodiments, the inner sleeve port assembly can include a plurality of individual inner sleeve openings, the plurality of individual inner sleeve openings spaced around a circumference of the inner sleeve to form a row of inner sleeve openings, and with two or more rows of inner sleeve openings spaced along an axial length of the inner sleeve. The outer sleeve port assembly can include a plurality of individual outer sleeve openings, the plurality of individual outer sleeve openings spaced around a circumference of the outer sleeve to form a row of outer sleeve openings, and with two or more rows of outer sleeve openings spaced along an axial length of the outer sleeve. The method can further include sealing between the inner sleeve and the outer sleeve with a plurality of port seals, each of the plurality of port seals forming a seal between the inner sleeve and the outer sleeve and where one of the plurality of port seals is located uphole of an uphole-most row of inner sleeve openings, another of the plurality of port seals is located downhole of a downhole-most row of inner sleeve openings, and other of the plurality of port seals are located between each adjacent row of inner sleeve openings.

In still yet other alternate embodiments, a sand skirt can be located uphole of the downhole packer, the sand skirt having a sloped inner diameter surface with an uphole end of the sand skirt having a larger inner diameter than an inner diameter of a downhole end of the sand skirt. A fluid discharge can be located between the pump and the protector assembly, the fluid discharge directing fluid out of the pump and into an annular space between an outer diameter surface of the electric submersible pump system and an inner diameter of the wellbore. A flow coupling can be located uphole of the motor, the flow coupling directing fluid from the annular space between the outer diameter surface of the electric submersible pump system and the inner diameter of the wellbore and into the production tubular. A stinger can be located downhole of the sand diverter, the stinger extending through the downhole packer and having a stinger inner bore in fluid communication with the diverter inner bore.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

FIG. 1 is a section view of a subterranean well with an electric submersible pump system and sand diverter in accordance with an embodiment of this disclosure, shown with a pump of the electric submersible pump system on.

FIG. 3 is a section view of a subterranean well with an electric submersible pump system and sand diverter in accordance with an embodiment of this disclosure, shown with a pump of the electric submersible pump system on.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
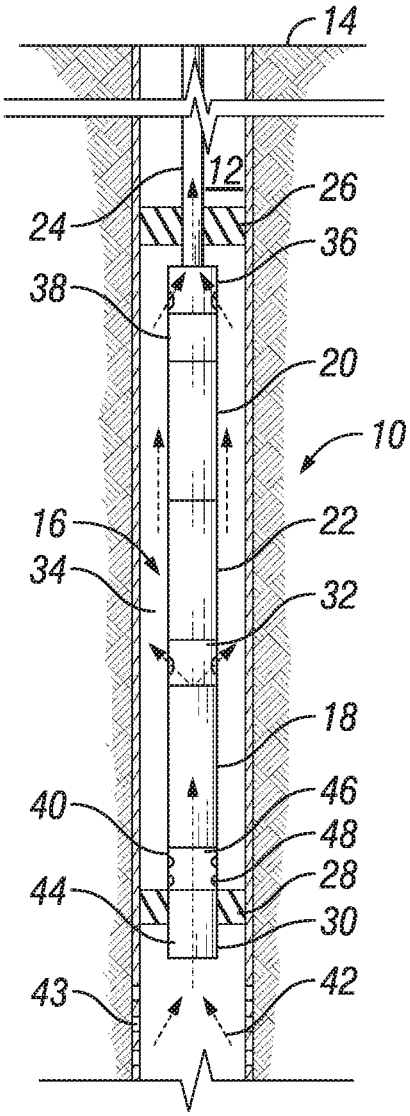
Figure 2:
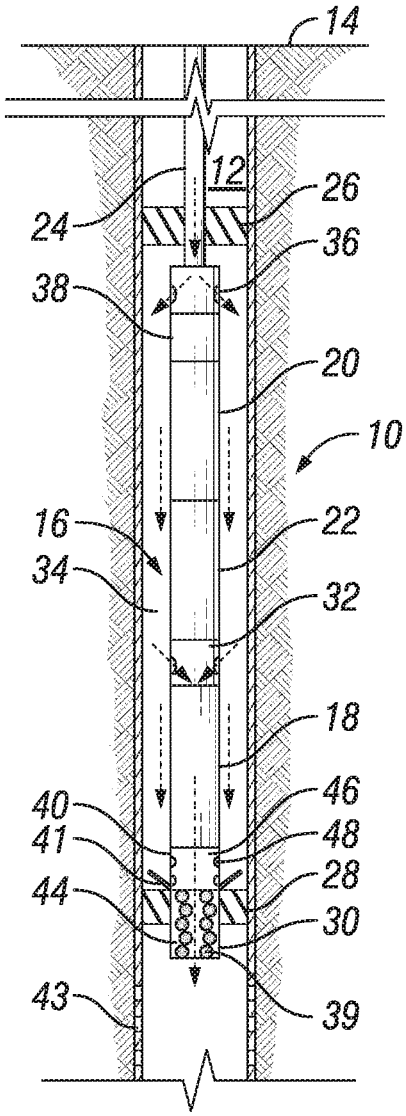
FIG. 2 is a section view of the subterranean well with the electric submersible pump system and a sand diverter in accordance with an embodiment of this disclosure, shown with the pump of the electric submersible pump system off.

Looking at FIGS. 1-2, subterranean well 10 can have wellbore 12 that extends to an earth's surface 14. Subterranean well 10 can be an offshore well or a land based well and can be used for producing fluids, such as producing hydrocarbons from subterranean hydrocarbon reservoirs. Submersible pump string 16 can be located within wellbore 12. Submersible pump string 16 can provide artificial lift to wellbore fluids. Submersible pump string 16 can include an electric submersible pump system (ESP) that has pump 18, motor 20, and protector assembly 22.

Pump 18 can be, for example, a rotary pump such as a centrifugal pump. Pump 18 could alternatively be a progressing cavity pump, which has a helical rotor that rotates within an elastomeric stator or other type of pump known in the art for use with an electric submersible pump assembly. Pump 18 can consist of stages, which are made up of impellers and diffusers. The impeller, which is rotating, adds energy to the fluid to provide head and the diffuser, which is stationary, converts the kinetic energy of fluid from the impeller into head. The pump stages can be stacked in series to form a multi-stage system that is contained within a pump housing. The sum of head generated by each individual stage is summative so that the total head developed by the multi-stage system increases linearly from the first to the last stage.

Pump 18 is located within wellbore 12 and is oriented to selectively boost the pressure of the wellbore fluids traveling from the wellbore towards the earth's surface 14 so that wellbore fluids can travel more efficiently to the earth's surface 14 through production tubular 24. Production tubular 24 extends within wellbore 12 to carry wellbore fluids from downhole to the earth's surface 14.

Motor 20 is also located within wellbore 12 and provides power to pump 18. Because embodiments of this disclosure provide for an inverted ESP, motor 20 is located uphole of pump 18. Protector assembly 22 is located between pump 18 and motor 20. Protector assembly 22 absorbs the thrust load from pump 18, transmits power from motor 20 to pump 18, equalizes pressure, receives additional motor oil as the temperature changes, and prevents wellbore fluid from entering motor 20.

Uphole packer 26 can be used to isolate the section of wellbore 12 that is uphole of uphole packer 26 from the section of wellbore 12 that contains submersible pump string 16. Uphole packer 26 can circumscribe production tubular 24 uphole of motor 20 and can seal around an inner diameter surface of wellbore 12. Uphole packer 26 can be, for example, an ESP feed-thru packer.

Downhole packer 28 can be located within wellbore 12 downhole of pump 18. Downhole packer 28 can be used to isolate the section of wellbore 12 that is downhole of downhole packer 28 from the section of wellbore 12 that contains submersible pump string 16. Downhole packer 28 can seal around the inner diameter surface of wellbore 12 and can circumscribe stinger 30. Downhole packer 28 can be, for example, a polished bore receptacle type of packer, allowing bypass stinger 30 to sting in so that stinger 30 extends through downhole packer 28.

Submersible pump string 16 can further include fluid discharge 32 that is located between pump 18 and protector assembly 22 and flow coupling 36 that is located uphole of motor 20. Fluid discharge 32 can direct fluid out of pump 18 and into annular space 34 between an outer diameter surface of the electric submersible pump system and an inner diameter of wellbore 12. Flow coupling 36 can direct fluid from annular space 34 and into production tubular 24. In alternate embodiments, submersible pump string 16 could be cable deployed. In such an embodiment, flow coupling 36 and uphole packer 26 may not be included.

Submersible pump string 16 can further include monitoring sub 38. Monitoring sub 38 can monitor conditions within wellbore 12 as well as monitor the operation of submersible pump string 16. Monitoring sub 38 can measure and transmit data, including pump intake and discharge temperature and pressure, motor oil and winding temperature, and vibration. As further discussed in this disclosure, submersible pump string 16 also includes sand diverter 40, which is located downhole of pump 18 and has flow port assembly 48 located uphole of downhole packer 28. Although sand diverter 40 is shown as a separate component, in alternate embodiments sand diverter 40 can be integrated with pump 18 or stinger 30.

In the embodiment of FIG. 1, pump 18 is on so that pump 18 is boosting the pressure of the wellbore fluids within wellbore 12 to assist the wellbore fluids in traveling in an uphole direction towards surface 14. As indicated by arrows 42, reservoir fluids will travel from perforations 43 downhole of downhole packer 28 and into stinger inner bore 44 of stinger 30 to pass by downhole packer 28. Stinger 30 is downhole of sand diverter 40, and stinger inner bore 44 is in fluid communication with diverter inner bore 46 of sand diverter 40 so that wellbore fluids passing into stinger inner bore 44 passes into and through diverter inner bore 46 to reach pump 18. Diverter inner bore 46 of sand diverter 40 is in fluid communication with wellbore 12 downhole of downhole packer 28 by way of stinger inner bore 44.

After passing through pump 18, fluid discharge 32 directs the wellbore fluid out of pump 18 and into annular space 34. The wellbore fluid continues to travel in an uphole direction past protector assembly 22, motor 20, and monitoring sub 38 and then flow coupling 36 directs the wellbore fluid from annular space 34 into production tubular 24 to be produced to the surface and treated and processed using conventional methods.

In the embodiment of FIG. 2, pump 18 is off, either intentionally or otherwise. With pump 18 off, the column of wellbore fluid within production tubular 24 moves in a direction downhole under the force of gravity. Wellbore fluid flowing downhole will pass through flow coupling 36 which will direct fluid out of production tubular 24 and into annular space 34. The wellbore fluid will pass by monitoring sub 38, motor 20, and protector assembly 22, and can enter fluid discharge 32 which will direct fluid from annular space 34 and into pump 18. From pump 18 the wellbore fluid can flow through diverter inner bore 46 of sand diverter 40 then through stinger inner bore 44 and exit stinger 30 downhole of downhole packer 28. Wellbore fluid that does not enter fluid discharge 32 can alternately remain within annular space 34 and continue to travel in a downhole direction towards downhole packer 28.

Solid particles 39, such as sand, can settle directly on downhole packer 28. When pump 18 is re-started, some solid particles 39 that settled on downhole packer 28 could remain on downhole packer 28 because the uphole surface of downhole packer 28 is outside of a fluid flow path. Repeated shutdown of pump 18 would result in an accumulation of solid deposits onto downhole packer 28. After an extended period of time, the accumulated sand can fuse to the outer diameter of stinger 30 and pump 18. This poses a problem during retrieval of the system because the equipment would have an enlarged outer diameter that would inhibit the equipment being pulled out of wellbore 12. In very extreme cases of solid accumulation, the solid particles 39 can fill the entire annular space 34 and fluid discharge 32 and flow coupling 36 could become blocked.

In the embodiment of FIG. 2, sand skirt 41 is located uphole of downhole packer 28. Sand skirt 41 has a sloped inner diameter surface with an uphole end of sand skirt 41 having a larger inner diameter than the inner diameter of the downhole end of sand skirt 41. In this way, any solid particles 39 that drop towards downhole packer 28 can be directed radially inward by the sloped inner diameter surface of sand skirt 41. Sand skirt may be particularly useful in subterranean wells 10 where annular space 34 is sufficiently large that solid particles 39 could land on a radially outward part of downhole packer 28 and be outside of a flow path that could direct such solid particles towards sand diverter 40.

Figure 3:
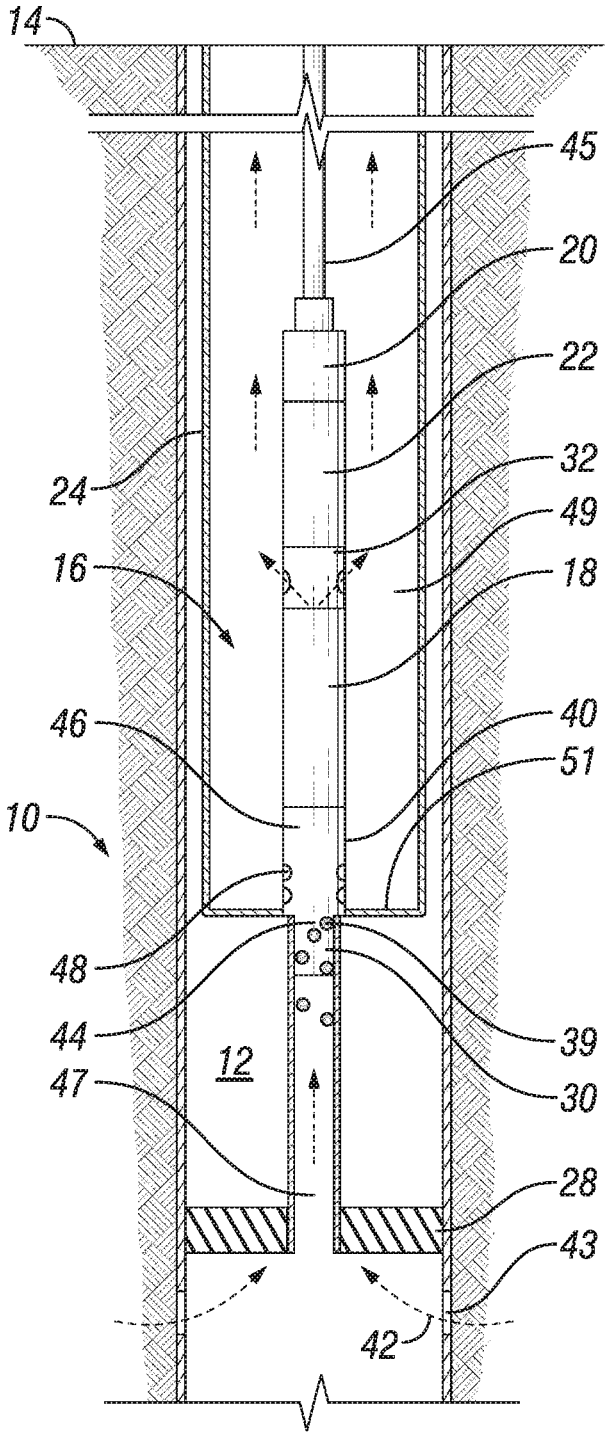

Looking at FIG. 3, in an alternate embodiment of the disclosure, submersible pump string 16 can be a through-tubing cable deployed ESP system. In such an embodiment, submersible pump string 16 is suspended within subterranean well 10 from surface 14 with cable 45 within production tubular 24. Downhole packer 28 can be located within wellbore 12 downhole of pump 18. Downhole packer 28 can seal around the inner diameter surface of wellbore 12 and can circumscribe polished bore receptacle 47. Stinger 30 can sting into polished bore receptacle 47 that extends through downhole packer 28.

Fluid discharge 32 is located between pump 18 and protector assembly 22 and can direct fluid out of pump 18 and into annular space 49 between an outer diameter surface of the electric submersible pump system and an inner diameter of production tubular 24.

In the embodiment of FIG. 3, pump 18 is on so that pump 18 is boosting the pressure of the wellbore fluids within wellbore 12 to assist the wellbore fluids in traveling in an uphole direction towards surface 14. As indicated by arrows 42, reservoir fluids will travel from perforations 43 downhole of downhole packer 28 and into stinger inner bore 44 of stinger 30. Stinger inner bore 44 is in fluid communication with diverter inner bore 46 of sand diverter 40 so that wellbore fluids passing into stinger inner bore 44 passes into and through diverter inner bore 46 to reach pump 18. Diverter inner bore 46 of sand diverter 40 is in fluid communication with wellbore 12 downhole of downhole packer 28 by way of stinger inner bore 44.

After passing through pump 18, fluid discharge 32 directs the wellbore fluid out of pump 18 and into annular space 49. The wellbore fluid continues to travel in an uphole direction past protector assembly 22 and motor 20 to be produced to the surface through production tubular 24 and can be treated and processed using conventional methods.

When pump 18 is off, either intentionally or otherwise the column of wellbore fluid within production tubular 24 moves in a direction downhole under the force of gravity. Wellbore fluid flowing downhole will pass motor 20, and protector assembly 22, and can enter fluid discharge 32 which will direct fluid from annular space 34 and into pump 18. From pump 18 the wellbore fluid can flow through diverter inner bore 46 of sand diverter 40 then through stinger inner bore 44 and exit stinger 30 and polished bore receptacle 47 downhole of downhole packer 28. Wellbore fluid that does not enter fluid discharge 32 can alternately remain within annular space 49 and continue to travel in a downhole direction towards upward facing surface 51 of production tubular 24.

Solid particles 39, such as sand, can settle directly on upward facing surface 51 of production tubular 24. After an extended period of time, the accumulated solid particles can accumulate in annular space 49 and fluid discharge 32 could become blocked.

Figure 4C:
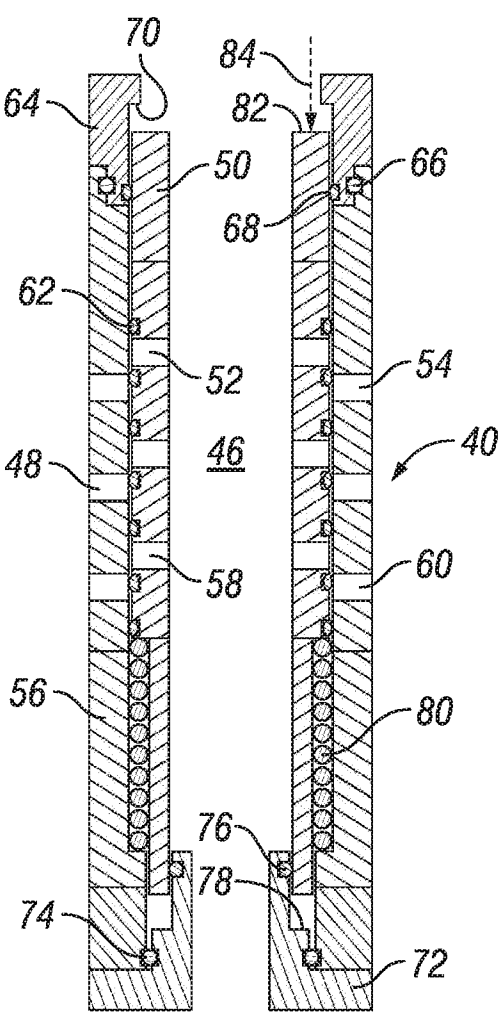
FIG. 4C is a section view of the sand diverter of FIG. 4A, shown with the inner sleeve in an intermediate closed position.
Figure 4B:
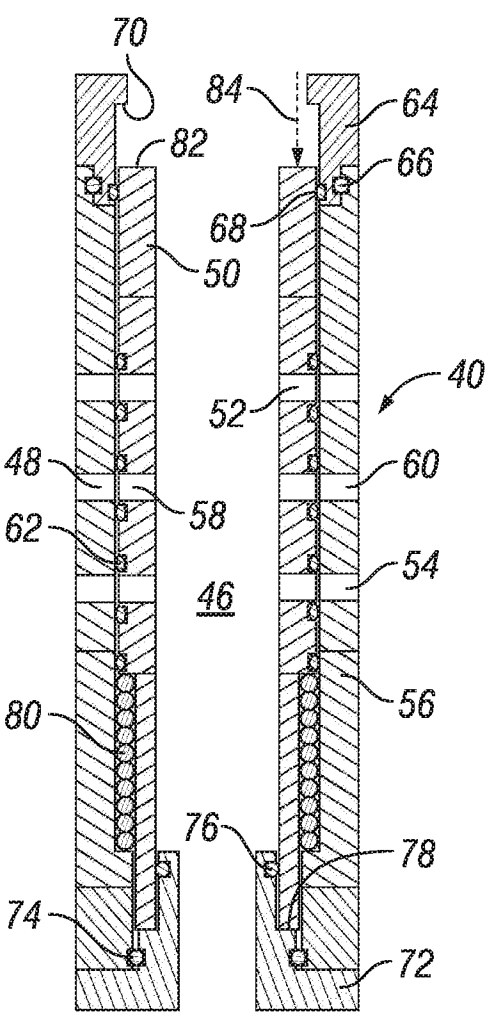
FIG. 4B is a section view of the sand diverter of FIG. 4A, shown with the inner sleeve in the open position.
Figure 4A:
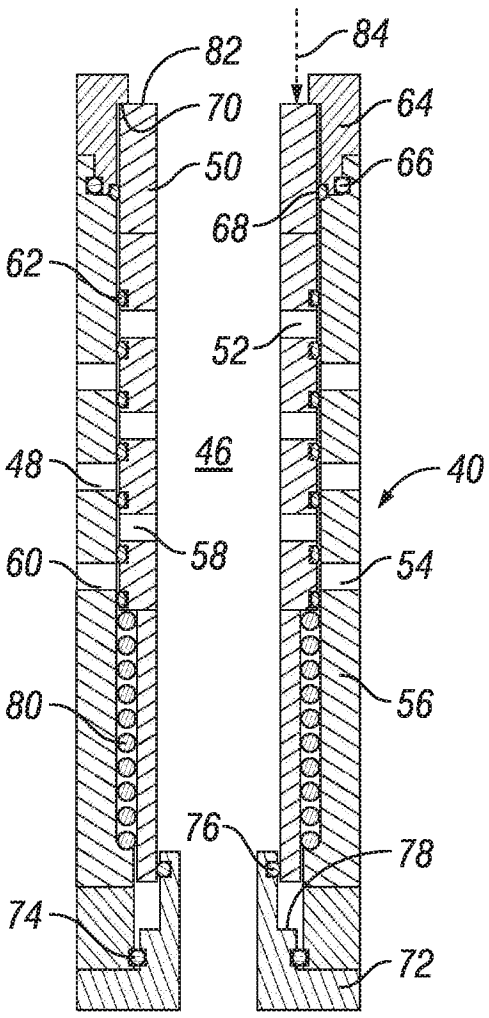
FIG. 4A is a section view of a sand diverter in accordance with an embodiment of this disclosure, shown with the inner sleeve in a fully extended station of the closed position.

Looking at FIGS. 4A-4C, sand diverter 40 can provide a flow path for solid particles 39 to pass downhole of downhole packer 28 or upward facing surface 51 of production tubular 24, as applicable, when pump 18 is turned off. Sand diverter 40 has inner sleeve 50 that is moveable between an open position (FIG. 4B) where inner sleeve port assembly 52 is aligned with outer sleeve port assembly 54 of outer sleeve 56, and a closed position (FIGS. 4A and 4C) where inner sleeve port assembly 52 is unaligned with outer sleeve port assembly 54.

Flow port assembly 48 can include a single inner sleeve opening 58. Alternately, inner sleeve port assembly 52 can include a plurality of individual inner sleeve openings 58. Individual inner sleeve openings 58 can be spaced around a circumference of inner sleeve 50 to form a row of inner sleeve openings 58. There can be a single row of inner sleeve openings 58. Alternately, there can be two or more rows of inner sleeve openings 58 spaced along an axial length of inner sleeve 50.

Outer sleeve port assembly 54 can have a number and pattern of individual outer sleeve openings 60 that correspond to the number and pattern of individual inner sleeve openings 58. In certain embodiments, outer sleeve port assembly 54 includes a plurality of individual outer sleeve openings 60, the individual outer sleeve openings 60 spaced around a circumference of outer sleeve 56 to form a row of outer sleeve openings 60. There can be a single row of outer sleeve openings 60. Alternately, there can be two or more rows of outer sleeve openings 60 spaced along an axial length of outer sleeve 56.

Sand diverter 40 further includes a plurality of port seals 62. Port seals 62 prevent migration of wellbore fluid through the clearance between the outer surface of inner sleeve 50 and the inner surface of outer sleeve 56. Port seals 62 can be O-rings that prevent the wellbore fluid from entering into sand diverter 40 or migrating out of sand diverter 40 between such clearance. Port seals 62 can form a seal between inner sleeve 50 and outer sleeve 56. One of the port seals 62 is located uphole of an uphole-most row of inner sleeve openings 58. One of the port seals 62 is located downhole of a downhole-most row of inner sleeve openings 58. Port seals 62 can also be located uphole and downhole of each adjacent row of inner sleeve openings 58.

In the embodiments shown in FIGS. 4A-4C, port seals 62 are shown installed around the outer diameter of inner sleeve 50. In alternate embodiments, port seals 62 can be installed into the internal surface of outer sleeve 56.

Sand diverter 40 further includes head member 64. Head member 64 is positioned uphole of outer sleeve 56 and can be secured to outer sleeve 56. Head member outer seal 66 can form a seal between head member 64 and outer sleeve 56. Head member inner seal 68 can form a seal between head member 64 and inner sleeve 50. Head member outer seal 66 and head member inner seal 68 can be O-rings.

Head member 64 can include head shoulder 70. Head shoulder 70 has a circumferential surface that faces downhole. Head shoulder 70 is positioned to limit uphole movement of inner sleeve 50 relative to outer sleeve 56. Looking at FIG. 4A, when an uphole end of inner sleeve 50 contacts head shoulder 70, inner sleeve 50 is in a fully extended station and inner sleeve 50 is in the closed position.

Sand diverter 40 further includes base member 72. Base member 72 is positioned downhole of outer sleeve 56. Base member outer seal 74 can form a seal between base member 72 and outer sleeve 56. Base member inner seal 76 can form a seal between base member 72 and inner sleeve 50. Base member outer seal 74 and base member inner seal 76 can be O-rings.

Base member 72 can include base shoulder 78. Base shoulder 78 has a circumferential surface that faces uphole and is positioned to limit downhole movement of inner sleeve 50 relative to outer sleeve 56. Looking at FIG. 4B, when a downhole end of inner sleeve 50 contacts base shoulder 78, inner sleeve 50 is in the open position.

Sand diverter 40 can include biasing member 80. In the embodiment of FIGS. 4A-4C, biasing member 80 is positioned to bias inner sleeve 50 towards the closed position. Sand diverter 40 can further include counter pressure member 82. In the embodiment of FIGS. 4A-4C, counter pressure member 82 is oriented so that when pump 18 is off, a force on counter pressure member 82 overrides a force of biasing member 80, moving inner sleeve 50 towards the open position.

Outer sleeve 56, head member 64, and base member 72 are each static relative to the other components of submersible pump string 16, such as pump 18 and motor 20. Inner sleeve 50 is movable relative to outer sleeve 56 and the other components of submersible pump string 16, such as pump 18 and motor 20. Biasing member 80 of the embodiment of FIGS. 4A-4C is sandwiched between inner sleeve 50 and outer sleeve 56. Biasing member 80 can be, for example, a spring that is under compression. The spring stiffness and contraction length are selected to provide the force required for operation of sand diverter 40 based on the final setting depth of sand diverter 40 and the properties of the wellbore fluids. In alternate embodiments, biasing member 80 can be located in alternate locations within sand diverter 40 that allows inner sleeve 50 to be biased towards the closed position.

For the embodiment shown in FIGS. 4A-4C, at the surface and before installation of sand diverter 40 in subterranean well 10, the uphole end of inner sleeve 50 contacts head shoulder 70, inner sleeve 50 is in a fully extended station and inner sleeve 50 is in the closed position. As such, the position of inner sleeve 50 as shown in FIG. 4A is the position of inner sleeve 50 at surface 14. Such a position is achieved by biasing member 80 biasing inner sleeve 50 towards the closed position.

As sand diverter 40 is lowered into subterranean well 10 towards the final setting depth, the uphole end of inner sleeve 50, which is exposed to wellbore fluid, experiences a hydrostatic pressure 84, which increases with depth. Hydrostatic pressure 84 pushes on inner sleeve 50 and compresses biasing member 80, as shown in FIG. 4C. The biasing force of biasing member 80 on inner sleeve 50 is balanced by the sum of the net of hydrostatic pressure 84 on inner sleeve 50, the frictional resistance of port seals 62 against the inside surface of outer sleeve 56, and the net weight of inner sleeve 50.

When sand diverter 40 is located at the final setting depth and pump 18 is off hydrostatic pressure 84, is greater than hydrostatic pressure 84 was at surface 14. At the final setting depth, the force of biasing member 80 has been overcome and inner sleeve 50 is pushed down so that the downhole end of inner sleeve 50 contacts base shoulder 78 and inner sleeve 50 is in the open position, as shown in FIG. 4B. Hydrostatic pressure 84 is greatest when there is no wellbore fluid flow through sand diverter 40.

Hydrostatic pressure 84 will depend on the density of the wellbore fluid and the depth of sand diverter 40 within wellbore 12. As an example, if sand diverter 40 is installed in wellbore 12 that contains wellbore fluid that is an oil with 0.8 specific gravity. Assuming the pressure gradient of such oil is about 0.346 pounds per square inch (psi) per foot (ft) and sand diverter 40 is located at a depth of 5000 ft, then hydrostatic pressure 84 is equal to 0.346 psi/ft multiplied by 5000 ft, or 1730 psi.

When pump 18 is turned on and wellbore fluid flows through sand diverter 40, the suction of pump 18 causes an amount of fluid flow through stinger inner bore 44 and inner bore 46 of sand diverter 40. Another amount of fluid flow passes into inner bore 46 of sand diverter 40 through 52 flow port assembly 48. As a result, the sum of pressures acting on inner sleeve 50 becomes less than the force applied by biasing member 80 and biasing member 80 biases inner sleeve 50 back towards the closed position.

When inner sleeve 50 is in the closed position, all the flow of wellbore fluid passes through stinger inner bore 44 and inner bore 46 of sand diverter 40 and none of the wellbore fluid can pass though flow port assembly 48. As more wellbore fluid is drawn through submersible pump string 16, hydrostatic pressure 84 on the uphole surface of inner sleeve 50 drops further and biasing member 80 biases inner sleeve towards head shoulder 70 until the uphole end of inner sleeve 50 contacts head shoulder 70, as shown in FIG. 4A.

In the event pump 18 is turned off the flow of wellbore fluid is reduced and hydrostatic pressure 84 increases and the sum of pressures acting on inner sleeve 50 becomes greater than the force applied by biasing member 80 and inner sleeve 50 moves towards the open position. Sand diverter 40 of the embodiment of FIGS. 4A-4C will function in such a way regardless of whether wellbore 12 is generally vertically oriented, inclined, or generally horizontally oriented.

Figure 5B:
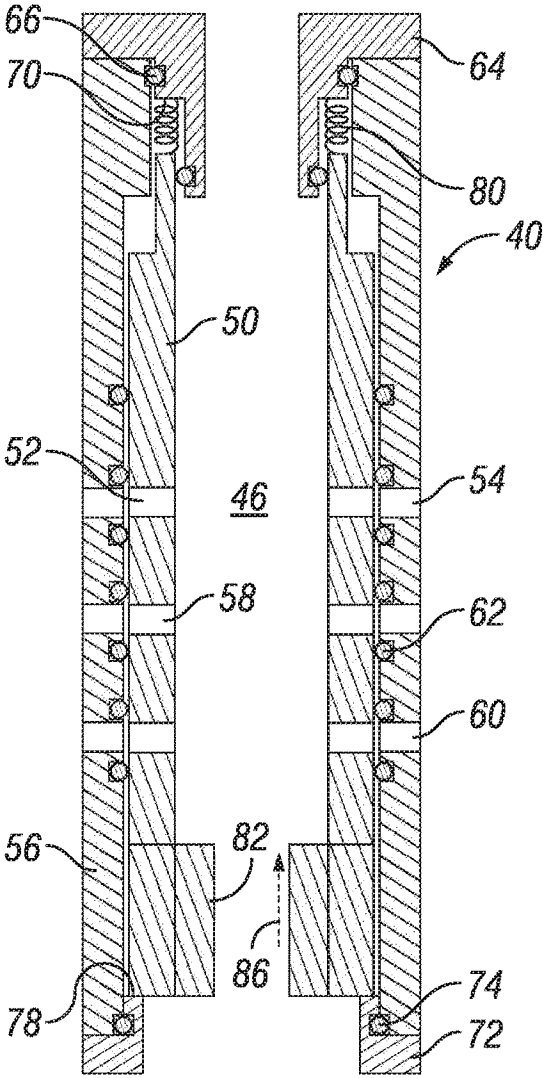
FIG. 5B is a section view of the sand diverter in accordance with an embodiment of this disclosure, shown with the inner sleeve in the open position.
Figure 5A:
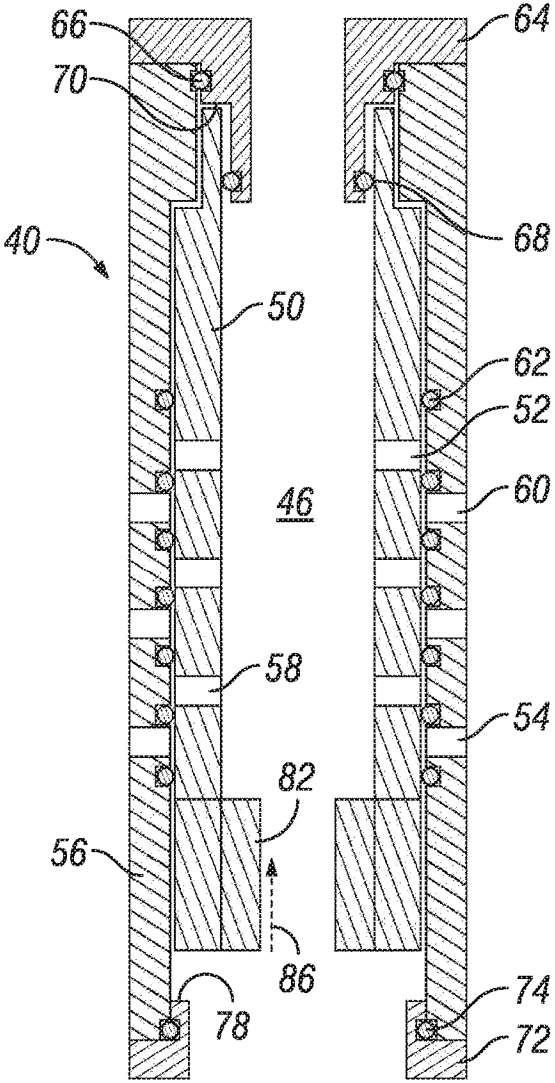
FIG. 5A is a section view of a sand diverter in accordance with an embodiment of this disclosure, shown with the inner sleeve in the closed position.

Looking at the embodiment of FIGS. 5A-5B, an alternate example sand diverter 40 is shown. Sand diverter 40 has inner sleeve 50 that is moveable between the open position (FIG. 5B) where inner sleeve port assembly 52 is aligned with outer sleeve port assembly 54 of outer sleeve 56, and the closed position (FIG. 5A) where inner sleeve port assembly 52 is unaligned with outer sleeve port assembly 54. Inner sleeve port assembly 52 is shown having a plurality of individual inner sleeve openings 58 spaced around a circumference of inner sleeve 50 to form a row of inner sleeve openings 58, and multiple rows of inner sleeve openings 58 spaced along an axial length of inner sleeve 50. Outer sleeve port assembly 54 is shown with a number and pattern of individual outer sleeve openings 60 that correspond to the number and pattern of individual inner sleeve openings 58.

Port seals 62 prevent migration of wellbore fluid through the clearance between the outer surface of inner sleeve 50 and the inner surface of outer sleeve 56. Port seals 62 can be O-rings that prevent the wellbore fluid from entering into sand diverter 40 or migrating out of sand diverter 40 between such clearance. Port seals 62 can form a seal between inner sleeve 50 and outer sleeve 56. In the embodiments shown in FIGS. 5A-5B, port seals 62 are shown installed around the internal surface of outer sleeve 56, uphole and downhole of each outer sleeve port assembly 54.

Head member 64 is positioned uphole of outer sleeve 56 and can be secured to outer sleeve 56. Head member outer seal 66 can form a seal between head member 64 and outer sleeve 56. Head member inner seal 68 can form a seal between head member 64 and inner sleeve 50. Head member outer seal 66 and head member inner seal 68 can be O-rings.

Head member 64 can include head shoulder 70. Head shoulder 70 is positioned to limit uphole movement of inner sleeve 50 relative to outer sleeve 56. Looking at FIG. 5A, when an uphole end of inner sleeve 50 contacts head shoulder 70, inner sleeve 50 is in a fully extended station and inner sleeve 50 is in the closed position. Base member 72 is positioned downhole of outer sleeve 56. Base member outer seal 74 can form a seal between base member 72 and outer sleeve 56. Base member outer seal 74 can be O-rings.

Base member 72 can include base shoulder 78. Base shoulder 78 is positioned to limit downhole movement of inner sleeve 50 relative to outer sleeve 56. Looking at FIG. 5B, when a downhole end of inner sleeve 50 contacts base shoulder 78, inner sleeve 50 is in the open position.

In the embodiment of FIG. 5A, there is no biasing member 80. In the embodiment of FIG. 5B, biasing member 80 is positioned to bias inner sleeve 50 towards the open position. Sand diverter 40 can further include counter pressure member 82. In the embodiment of FIGS. 5A-5B, counter pressure member 82 is oriented so that when pump 18 is off, a force on counter pressure member 82 overrides a force of biasing member 80 and the force of gravity, moving inner sleeve 50 towards the closed position.

Outer sleeve 56, head member 64, and base member 72 are each static relative to the other components of submersible pump string 16, such as pump 18 and motor 20. Inner sleeve 50 is movable relative to outer sleeve 56 and the other components of submersible pump string 16, such as pump 18 and motor 20. Biasing member 80 of the embodiment of FIG. 5B is shown sandwiched between inner sleeve 50 and head member 64. Biasing member 80 can be, for example, a spring that is under compression. The spring stiffness and contraction length are selected to provide the force required for operation of sand diverter 40 based on the final setting depth of sand diverter 40 and the properties of the wellbore fluids. In alternate embodiments, biasing member 80 can be located in alternate locations within sand diverter 40 that allows inner sleeve 50 to be biased towards the open position.

For the embodiment shown in FIGS. 5A-5B, at the surface and before installation of sand diverter 40 in subterranean well 10, the downhole end of inner sleeve 50 contacts base shoulder 78 and inner sleeve 50 is in the open position. As such, the position of inner sleeve 50 as shown in FIG. 5B is the position of inner sleeve 50 at surface 14. Such a position is achieved by biasing member 80 biasing inner sleeve 50 towards the open position, or alternately, by inner sleeve 50 resting on base shoulder 78 under the force of gravity.

When sand diverter 40 is located at the final setting depth and pump 18 is off inner sleeve 50 will remain in the open position before pump 18 is turned on. If there is no biasing member 80, then the weight of inner sleeve 50 is sufficient to overcome any net fluid hydrostatic force that will tend to push inner sleeve 50 towards the closed position when pump 18 is off. The required weight of inner sleeve 50 can be obtained by the selecting suitable material densities and volumes to form inner sleeve 50.

When pump 18 is turned on and wellbore fluid flows through sand diverter 40, the suction of pump 18 causes an amount of fluid flow through stinger inner bore 44 and inner bore 46 of sand diverter 40. Another amount of fluid flow passes into inner bore 46 of sand diverter 40 through 52 flow port assembly 48. As a result of the flow through inner bore 46 of sand diverter 40, a drag force 86 is applied to counter pressure member 82. Drag force 86 will be sufficient to overcome the weight of inner sleeve 50, the frictional resistance of port seals 62 against the inside surface of outer sleeve 56, and any biasing member 80, and will move inner sleeve 50 to the closed position of FIG. 5A.

Drag force 86 is a function of the fluid flow rate, fluid density, cross-sectional area of the inner sleeve 50 upstream of, downstream of, and at counter pressure member 82, and the geometric shape of counter pressure member 82. Due to the contraction and expansion of inner bore 46 of sand diverter 40 caused by counter pressure member 82, the hydrostatic pressure upstream of the counter pressure member 82 is greater than the hydrostatic pressure downstream of counter pressure member 82. In addition, the cross-sectional area of the downhole face of counter pressure member 82 in contact with wellbore fluid is greater than the cross-sectional area of the uphole face of counter pressure member 82. This difference in cross-sectional areas increases drag force 86. For a given target flow rate and corresponding fluid density at the specified setting depth, the geometry of counter pressure member 82 can be designed to provide a drag force 86 sufficient to lift inner sleeve 50 to the closed position.

When inner sleeve 50 is in the closed position, all the flow of wellbore fluid passes through stinger inner bore 44 and inner bore 46 of sand diverter 40 and none of the wellbore fluid can pass though flow port assembly 48. As more wellbore fluid is drawn through submersible pump string 16, drag force 86 is greater when inner sleeve 50 is in the closed position.

When pump 18 is turned off again, drag force 86 will be reduced and the force of gravity on inner sleeve 50 and the bias force applied by biasing member 80 will be sufficient to move inner sleeve 50 back to the open position. In certain embodiments, with pump 18 off drag force 86 will be zero.

Sand diverter 40 of the example embodiments of FIGS. 5A-5B are suitable for generally vertical or inclined wells. For a generally horizontal oriented wellbore 12, biasing member 80 would be required to return inner sleeve 50 to the open position since the force of gravity would not assist in moving inner sleeve 50 to the open position.

In an example of operation and looking at FIGS. 1-2, in order to provide artificial lift to wellbore fluids submersible pump string 16 can be set within wellbore 12. Submersible pump string 16 includes sand diverter 40, which is located downhole of pump 18 and has flow port assembly 48 located uphole of the downhole packer. While pump 18 is running and inner sleeve 50 is in the closed position, wellbore fluid from within wellbore downhole of downhole packer 28 passes into stinger inner bore 44 of stinger 30 to pass by downhole packer 28. Wellbore fluids passing into stinger inner bore 44 pass into and through diverter inner bore 46 to reach pump 18.

Fluid discharge 32 can direct fluid out of pump 18 and into annular space 34 between an outer diameter surface of the electric submersible pump system and an inner diameter of wellbore 12. Flow coupling 36 can direct fluid from annular space 34 and into production tubular 24 for delivery to the surface.

When pump 18 is turned off, inner sleeve 50 moves to the open position the column of wellbore fluid within production tubular 24 moves in a direction downhole under the force of gravity. Wellbore fluid flowing downhole will pass through flow coupling 36 which will direct fluid out of production tubular 24 and into annular space 34. Some wellbore fluid will enter fluid discharge 32 which will direct fluid from annular space 34 and into pump 18. Wellbore fluid that does not enter fluid discharge 32 can alternately remain within annular space 34 and continue to travel in a downhole direction towards downhole packer 28.

Solid particles 39 that are suspended in the wellbore fluid and does not flow through fluid discharge 32 can move towards downhole packer 28. With inner sleeve 50 in the open position, solid particles 39 can pass through flow port assembly 48 and into diverter inner bore 46. From diverter inner bore 46, the solid particles can pass through stinger inner bore 44 of stinger 30 and exit stinger 30 downhole of downhole packer 28. When pump 18 is re-started, inner sleeve 50 moves to the closed position, as described in this disclosure.

Embodiments described in this disclosure therefore provide systems and methods for minimizing sand accumulation within the annulus when a pump of an inverted ESP system is turned off or otherwise shut down. Systems and methods of this disclosure therefore reduce pump discharge blockages and associated increased operating costs, improving operating efficiency. Embodiments of this disclosure also reduce the amount of solid particles flowing back through the ESP, increasing ESP run life. Systems and methods of this disclosure additionally reduces costly workover resulting from equipment getting stuck within the wellbore due to the fusion of solid particles to the equipment. Embodiments of this disclosure can be integrated into current ESP systems.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for providing artificial lift to wellbore fluids, the system having:

a pump located within a wellbore, the pump oriented to selectively boost a pressure of the wellbore fluids traveling from the wellbore towards an earth's surface through a production tubular;

a motor located within the wellbore uphole of the pump and providing power to the pump;

a protector assembly located between the pump and the motor, where the pump, the motor, and the protector assembly form an electric submersible pump system;

a downhole packer located within the wellbore downhole of the pump;

a sand diverter located downhole of the pump and having a flow port assembly located uphole of the downhole packer, the sand diverter having a diverter inner bore open to the wellbore downhole of the downhole packer, where the flow port assembly has an inner sleeve that is moveable between an open position where an inner sleeve port assembly is aligned with an outer sleeve port assembly of an outer sleeve, and a closed position where the inner sleeve port assembly is unaligned with the outer sleeve port assembly, and where the diverter inner bore is open to the wellbore downhole of the downhole packer both when the inner sleeve is in the open position and when the inner sleeve is in the closed position, the sand diverter further including:

a base member located at a downhole end of the outer sleeve;

a base member outer seal extending radially outward from the base member and sealing between an outer diameter of the base member and an inner diameter of the outer sleeve;

a base member inner seal extending radially outward from the base member and sealing between the outer diameter of the base member and an inner diameter of the inner sleeve;

a biasing member positioned radially outward of the inner sleeve and radially inward of the outer sleeve; and a sand skirt located uphole of the downhole packer, the sand skirt having a sloped inner diameter surface with an uphole end of the sand skirt having a larger inner diameter than an inner diameter of a downhole end of the sand skirt; where the sand diverter further includes a plurality of port seals, each of the plurality of port seals forming a seal between the inner sleeve and the outer sleeve and where one of the plurality of port seals is located uphole of an uphole-most row of inner sleeve openings, one of the plurality of port seals is located downhole of a downhole-most row of inner sleeve openings, and other of the plurality of port seals are located between each adjacent row of inner sleeve openings.

2. The system of claim 1, where the biasing member is positioned to bias the inner sleeve towards the closed position.

3. The system of claim 2, where the sand diverter further includes a counter pressure member, the counter pressure member oriented so that when the pump is off, a force on the counter pressure member overrides a force of the biasing member, moving the inner sleeve towards the open position.

4. The system of claim 1, where the biasing member is positioned to bias the inner sleeve towards the open position.

5. The system of claim 4, where the sand diverter further includes a counter pressure member, the counter pressure member oriented so that when the pump is on, a force on the counter pressure member overrides a force of the biasing member, moving the inner sleeve to the closed position.

6. The system of claim 1, where the sand diverter further includes a head member, the head member positioned uphole of the outer sleeve and having a head shoulder positioned to limit uphole movement of the inner sleeve relative to the outer sleeve.

7. The system of claim 6, where the inner sleeve has a fully extended station where an uphole end of the inner sleeve contacts the head shoulder, and where in the fully extended station the inner sleeve is in the closed position.

8. The system of claim 1, where the base member has a base shoulder positioned to limit downhole movement of the inner sleeve relative to the outer sleeve.

9. The system of claim 8, where the inner sleeve has a fully contracted station where a downhole end of the inner sleeve contacts the base shoulder, and where in the fully contracted station the inner sleeve is in the open position.

10. The system of claim 1, where:

the inner sleeve port assembly includes a plurality of individual inner sleeve openings, the plurality of individual inner sleeve openings spaced around a circumference of the inner sleeve to form a row of inner sleeve openings, and with two or more rows of inner sleeve openings spaced along an axial length of the inner sleeve; and the outer sleeve port assembly includes a plurality of individual outer sleeve openings, the plurality of individual outer sleeve openings spaced around a circumference of the outer sleeve to form a row of outer sleeve openings, and with two or more rows of outer sleeve openings spaced along an axial length of the outer sleeve.

11. The system of claim 1, further including:

a fluid discharge located between the pump and the protector assembly, the fluid discharge directing fluid out of the pump and into an annular space between an outer diameter surface of the electric submersible pump system and an inner diameter of the wellbore; and a flow coupling located uphole of the motor, the flow coupling directing fluid from the annular space between the outer diameter surface of the electric submersible pump system and the inner diameter of the wellbore and into the production tubular.

12. The system of claim 1, further including a stinger located downhole of the sand diverter, the stinger extending through the downhole packer and having a stinger inner bore in fluid communication with the diverter inner bore.

13. A method for providing artificial lift to wellbore fluids, the method including:

locating a pump within a wellbore, the pump oriented to selectively boost a pressure of the wellbore fluids traveling from the wellbore towards an earth's surface through a production tubular;

locating a motor within the wellbore uphole of the pump and providing power to the pump with the motor;

locating a protector assembly between the pump and the motor, where the pump, the motor, and the protector assembly form an electric submersible pump system;

locating a downhole packer within the wellbore downhole of the pump;

locating a sand skirt uphole of the downhole packer, the sand skirt having a sloped inner diameter surface with an uphole end of the sand skirt having a larger inner diameter than an inner diameter of a downhole end of the sand skirt; and locating a sand diverter downhole of the pump such that a flow port assembly of the sand diverter is located uphole of the downhole packer, the sand diverter having a diverter inner bore open to the wellbore downhole of the downhole packer, where the flow port assembly has an inner sleeve that is moveable between an open position where an inner sleeve port assembly is aligned with an outer sleeve port assembly of an outer sleeve, and a closed position where the inner sleeve port assembly is unaligned with the outer sleeve port assembly, and where the diverter inner bore is open to the wellbore downhole of the downhole packer both when the inner sleeve is in the open position and when the inner sleeve is in the closed position, the sand diverter further including:

a base member located at a downhole end of the outer sleeve;

a base member outer seal extending radially outward from the base member and sealing between an outer diameter of the base member and an inner diameter of the outer sleeve;

a base member inner seal extending radially outward from the base member and sealing between the outer diameter of the base member and an inner diameter of the inner sleeve; and a biasing member positioned radially outward of the inner sleeve and radially inward of the outers sleeve; where the sand diverter further includes a plurality of port seals, each of the plurality of port seals forming a seal between the inner sleeve and the outer sleeve and where one of the plurality of port seals is located uphole of an uphole-most row of inner sleeve openings, one of the plurality of port seals is located downhole of a downhole-most row of inner sleeve openings, and other of the plurality of port seals are located between each adjacent row of inner sleeve openings.

14. The method of claim 13, further including biasing the inner sleeve towards the closed position with the biasing member.

15. The method of claim 14, where the sand diverter further includes a counter pressure member, the counter pressure member oriented so that when the pump is off, a force on the counter pressure member overrides a force of the biasing member, moving the inner sleeve towards the open position.

16. The method of claim 13, further including biasing the inner sleeve towards the open position with the biasing member.

17. The method of claim 16, where the sand diverter further includes a counter pressure member, the counter pressure member oriented so that when the pump is on, a force on the counter pressure member overrides a force of the biasing member, moving the inner sleeve to the closed position.

18. The method of claim 13, further including limiting uphole movement of the inner sleeve relative to the outer sleeve with a head shoulder of a head member of the sand diverter, the head member positioned uphole of the outer sleeve.

19. The method of claim 13, further including limiting downhole movement of the inner sleeve relative to the outer sleeve with a base shoulder of the base member of the sand diverter.

20. The method of claim 13, further including:

locating a fluid discharge between the pump and the protector assembly, the fluid discharge directing fluid out of the pump and into an annular space between an outer diameter surface of the electric submersible pump system and an inner diameter of the wellbore; and locating a flow coupling uphole of the motor, the flow coupling directing fluid from the annular space between the outer diameter surface of the electric submersible pump system and the inner diameter of the wellbore and into the production tubular.

21. The method of claim 13, further including locating a stinger downhole of the sand diverter, the stinger extending through the downhole packer and having a stinger inner bore in fluid communication with the diverter inner bore.

22. A system for providing artificial lift to wellbore fluids, the system having:

a pump located within a wellbore, the pump oriented to selectively boost a pressure of the wellbore fluids traveling from the wellbore towards an earth's surface through a production tubular;

a motor located within the wellbore uphole of the pump and providing power to the pump;

a protector assembly located between the pump and the motor, where the pump, the motor, and the protector assembly form an electric submersible pump system;

a downhole packer located within the wellbore downhole of the pump;

a sand diverter located downhole of the pump and having a flow port assembly located uphole of the downhole packer, the sand diverter having a diverter inner bore open to the wellbore downhole of the downhole packer, where the flow port assembly has an inner sleeve that is moveable between an open position where an inner sleeve port assembly is aligned with an outer sleeve port assembly of an outer sleeve, and a closed position where the inner sleeve port assembly is unaligned with the outer sleeve port assembly, and where the diverter inner bore is open to the wellbore downhole of the downhole packer both when the inner sleeve is in the open position and when the inner sleeve is in the closed position, the sand diverter further including:

a head member located at an uphole end of the outer sleeve;

a head member outer seal extending radially outward from the head member and sealing between an outer diameter of the head member and an inner diameter of the outer sleeve;

a head member inner seal extending radially outward from the head member and sealing between the outer diameter of the head member and an inner diameter of the inner sleeve;

a biasing member positioned radially inward of the outers sleeve; and a sand skirt located uphole of the downhole packer, the sand skirt having a sloped inner diameter surface with an uphole end of the sand skirt having a larger inner diameter than an inner diameter of a downhole end of the sand skirt; where the sand diverter further includes a plurality of port seals, each of the plurality of port seals forming a seal between the inner sleeve and the outer sleeve and where one of the plurality of port seals is located uphole of an uphole-most row of inner sleeve openings, one of the plurality of port seals is located downhole of a downhole-most row of inner sleeve openings, and other of the plurality of port seals are located between each adjacent row of inner sleeve openings.

23. A method for providing artificial lift to wellbore fluids, the method including:

locating a pump within a wellbore, the pump oriented to selectively boost a pressure of the wellbore fluids traveling from the wellbore towards an earth's surface through a production tubular;

locating a motor within the wellbore uphole of the pump and providing power to the pump with the motor;

locating a protector assembly between the pump and the motor, where the pump, the motor, and the protector assembly form an electric submersible pump system;

locating a downhole packer within the wellbore downhole of the pump;

locating a sand skirt uphole of the downhole packer, the sand skirt having a sloped inner diameter surface with an uphole end of the sand skirt having a larger inner diameter than an inner diameter of a downhole end of the sand skirt; and locating a sand diverter downhole of the pump such that a flow port assembly of the sand diverter is located uphole of the downhole packer, the sand diverter having a diverter inner bore open to the wellbore downhole of the downhole packer, where the flow port assembly has an inner sleeve that is moveable between an open position where an inner sleeve port assembly is aligned with an outer sleeve port assembly of an outer sleeve, and a closed position where the inner sleeve port assembly is unaligned with the outer sleeve port assembly, and where the diverter inner bore is open to the wellbore downhole of the downhole packer both when the inner sleeve is in the open position and when the inner sleeve is in the closed position, the sand diverter further including:

a head member located at an uphole end of the outer sleeve;

a head member outer seal extending radially outward from the head member and sealing between an outer diameter of the head member and an inner diameter of the outer sleeve;

a head member inner seal extending radially outward from the head member and sealing between the outer diameter of the head member and an inner diameter of the inner sleeve;

a biasing member positioned radially inward of the outers sleeve; where the sand diverter further includes a plurality of port seals, each of the plurality of port seals forming a seal between the inner sleeve and the outer sleeve and where one of the plurality of port seals is located uphole of an uphole-most row of inner sleeve openings, one of the plurality of port seals is located downhole of a downhole-most row of inner sleeve openings, and other of the plurality of port seals are located between each adjacent row of inner sleeve openings.

* * * * *